United States Patent [19]

Howell

[11] 4,296,665

[45] Oct. 27, 1981

[54] FILL NOTE GENERATOR FOR ELECTRONIC ORGAN

[75] Inventor: Stephen L. Howell, Huntingburg, Ind.

[73] Assignee: Kimball International, Inc., Jasper, Ind.

[21] Appl. No.: 149,262

[22] Filed: May 12, 1980

[51] Int. Cl.[3] ..... G10F 1/00; G10H 1/02

[52] U.S. Cl. ..... 84/1.03; 84/1.24; 84/1.17

[58] Field of Search ..... 84/1.01, 1.03, 1.17, 84/1.24

[56] References Cited

U.S. PATENT DOCUMENTS

| | | | |
|---|---|---|---|
| 3,283,056 | 11/1966 | Cookerly et al. | 84/1.01 |
| 3,745,225 | 7/1973 | Hall | 84/1.03 |
| 3,746,773 | 7/1973 | Uetrecht . | |
| 3,823,246 | 7/1974 | Hebeisen et al. | 84/1.17 |
| 3,929,051 | 12/1975 | Moore | 84/1.03 X |
| 3,990,339 | 11/1976 | Robinson et al. | 84/1.03 |
| 4,011,784 | 3/1977 | Furui | 84/1.03 |
| 4,033,221 | 7/1977 | Tomisawa et al. | 84/1.03 |
| 4,052,924 | 10/1977 | Deutsch et al. | 84/1.03 |
| 4,108,037 | 8/1978 | Robinson et al. | 84/1.03 |
| 4,112,802 | 9/1978 | Robinson et al. | 84/1.03 |
| 4,120,225 | 10/1978 | Dietrich et al. | 84/1.03 |
| 4,166,405 | 9/1979 | Hiyoshi et al. | 84/1.03 |
| 4,185,530 | 1/1980 | Robinson et al. | 84/1.03 |
| 4,187,756 | 2/1980 | Robinson et al. | 84/1.24 |
| 4,217,804 | 8/1980 | Yamaga et al. | 84/1.24 |
| 4,220,068 | 9/1980 | Howell et al. | 84/1.03 |
| 4,235,142 | 11/1980 | Nakada et al. | 84/1.24 |

*Primary Examiner*—J. V. Truhe
*Assistant Examiner*—Forester W. Isen
*Attorney, Agent, or Firm*—Albert L. Jeffers; John F. Hoffman

[57] ABSTRACT

A fill note generator for use in electronic musical instruments such as electronic organs which include a keyboard having a solo portion customarily played by the right hand and an accompaniment portion customarily played by the left hand, and wherein the respective solo and accompaniment portions may be on separate manuals or on a single manual. A multiplexer scans the keys of the solo portion of the keyboard and generates a time division multiplexed solo data stream having keydown signals in discrete time slots for each actuated key of the solo portion of the keyboard. The keys of the accompaniment portion of the keyboard are interconnected so as to form twelve sets corresponding to the twelve pitches of the chromatic scale wherein the keys in each set are connected to a common output. A multistage shift register, which is synchronized with the multiplexer for the solo manual, has its load inputs connected to the outputs of the interconnected sets of accompaniment keys and produces on its output a fill note time division multiplexed data stream comprising keydown signals in time slots corresponding to the keydown signals loaded into its inputs from the outputs of the sets of accompaniment keys. The inputs, which are loaded once each scan of the solo portion of the keyboard, are recirculated in the shift register so that the pattern repeats itself once each octave of the scan of the solo portion of the keyboard.

20 Claims, 7 Drawing Figures

FILL NOTE GENERATOR FOR ELECTRONIC ORGAN

BACKGROUND OF THE INVENTION

The present invention relates to electronic organs wherein the solo manual is multiplexed, and in particular to a system for generating fill notes wherein scanning or multiplexing of the accompaniment manual is not necessary.

Present-day electronic organs include keyboards which are either of the single manual variety, as in the case of spinet organs, or plural manual variety, as in the case of larger console or theater organs. In the case of a single manual organ, the keys on the right portion of the keyboard corresponding to the higher frequency notes are customarily played by the right hand of the performer, and the keys on the left portion of the keyboard corresponding to the lower frequency notes are customarily played by the left hand. In two manual organs, wherein each manual may be a full sixty-one note manual or, alternatively, two forty-four note manuals which are offset relative to each other, the upper manual is generally played by the right hand and the lower manual by the left hand. The upper manual and the right hand portion of the spinet keyboard are generally referred to as the solo manual, and the lower manual and left hand portion of the spinet keyboard are generally referred to as the accompaniment manual.

In playing such an instrument, chords are generally formed by depressing the appropriate keys on the accompaniment manual, and the melody is generally played on the solo manual. The melody may be played monophonically or polyphonically, depending on the skill of the performer. The fullness of the sound produced by playing the organ can be greatly enhanced if chords harmonically compatible with the chords played on the accompaniment manual are also played on the solo manual together with the melody note or notes. Although the full chord may not be played, it is customary to play one or two notes of the chord, known as fill notes. This technique requires a high degree of skill, however, particularly in view of the fact that the fill notes must be held as other melody notes are played.

In order to enable beginning and intermediate players to achieve the same fullness of sound achieved by more advanced players who are capable of playing the fill notes, systems have been developed for generating fill notes of this nature automatically by mechanically or electronically coupling signals resulting from playing keys on the accompaniment manual to the tone producing circuitry such that the notes will sound as if they were played on the solo manual, preferably within an octave or two of the highest note which is played on the solo manual. The following patents are exemplary of prior art systems for automatically generating fill notes in electronic organs: U.S. Pat. Nos. 3,283,056; 3,745,225; 3,823,246; 3,247,310; 3,990,339; 3,929,051; and 4,112,802.

The disadvantage to the earlier fill note generation systems, such as those disclosed in U.S. Pat. Nos. 3,283,056 and 3,823,246 is that they require cumbersome mechanical or electronic interconnection of the key switches. Although this problem was alleviated by systems such as those of U.S. Pat. Nos. 3,990,339 and 4,112,802, they are more suited to automatic chord systems wherein the chord information is developed by the depression of a single key in the accompaniment manual. U.S. Pat. No. 3,929,051 discloses a system which is usable in the alternative configuration, wherein the chords must be manually played on the accompaniment manual to generate the fill note information. In this system, however, the accompaniment keys, or at least interconnected groups thereof, are scanned by the drivers which also scan the keys of the solo manual. This results in a restrictive system and the interconnection circuitry is quite unwieldy.

SUMMARY OF THE INVENTION

The above problems and disadvantages of prior art fill note generation systems are overcome by the present invention that enables a statically generated word corresponding to the depressed keys of the accompaniment manual to be incorporated into a multiplexed system without the necessity for scanning or multiplexing the keys of the accompaniment manual. The static twelve bit binary word is loaded into the stages of a twelve bit shift register on each scan of the solo manual, and the word is then recirculated through the shift register in synchronism with the scan of the solo manual so that there appears at the output of the shift register a time division multiplexed fill note data stream which is always in step with the solo data stream generated by the separate solo manual multiplexer.

A window is defined so that the fill notes will sound only in the octave immediately below the highest note which is played on the solo manual thereby simulating the standard technique for playing fill notes manually. This is accomplished by interrupting the recirculation of the data stream through the shift register when the first occurring note on the solo data stream is detected. This permits the shift register to empty itself by producing keydown pulses in some of the twelve time slots immediately below the time slot of the solo note. At the end of the scan of the solo manual, the shift register is again loaded with the twelve bit binary word corresponding to the depressed keys of the accompaniment manual and this word is then recirculated for the next scan.

In order to prevent dissonance which might occur if fill notes are played within one or two notes of the solo note, the three endmost stages of the shift register are cleared when the solo note occurs. If desired, the four lowest fill notes which would otherwise be played may also be eliminated by clearing the first four stages of the shift register.

Specifically, the present invention relates to an electronic musical instrument comprising a keyboard having a plurality of playing keys actuating respective keyswitches and compising a solo portion customarily played by the right hand and an accompaniment portion customarily played by the left hand, wherein the playing keys correspond to notes of the musical scale. A multiplexer scans the keyswitches of the solo portion of the keyboard and generates on an output a time division multiplexed solo data stream on each scan of the keyboard comprising keydown signals in respective discrete time slots for each actuated keyswitch of the solo portion of the keyboard. At least a group of the keys of the accompaniment portion of the keyboard are interconnected in a plurality of sets such that each set comprises all of the keyswitches in the group corresponding to a particular pitch of an octave length chromatic scale and the keyswitches in each set are connected to a common output. A multistage shift register synchronized with the multiplexer has a plurality of load inputs at respective ones of its stages connected to the respective outputs of the accompaniment portion keyswitches and produces on an output a fill note time division multiplexed data stream comprising keydown signals in time slots corresponding to keydown signals loaded into its inputs from the outputs of the sets of accompaniment keyswitches. A window circuit, having an input connected to the output of the shift register and an input connected to the output on which the solo data stream appears and an output, gates to its output the data stream on the output of the shift register for a predetermined number of time slots following receipt by the window circuit of a predetermined keydown signal, such as the first occurring keydown signal, in the solo data stream. Output and demultiplexing circuitry connected to the output of the window circuit is controlled by the fill note data stream thereon for producing tones in accordance with the keydown signals in the fill note data stream.

The present invention also relates to a method for producing fill notes in an electronic keyboard musical instrument having a plurality of playing keys actuating respective keyswitches and comprising a solo portion customarily played by the right hand and an accompaniment portion customarily played by the left hand. The method comprises scanning the keyswitches of the solo portion of the keyboard and producing a time division multiplexed solo data stream on each scan of the keyboard comprising keydown signals in respective discrete time slots for each actuated keyswitch of the solo portion of the keyboard, producing a parallel format data word comprising twelve bit locations corresponding to the twelve notes of the chromatic scale and wherein keydown signals are present in bit locations corresponding to depressed keys of the accompaniment manual of the same notes, recirculating the data word through a recirculating storage device a plurality of times during each scan of the keyboard such that, at an output of the storage device, a fill note time division multiplexed data stream is produced which is synchronized with the solo data stream, and demultiplexing only that portion of the fill note data stream that occurs after the first actuated keyswitch of the solo portion of the keyboard is scanned and only for a predetermined number of time slots less than or equal to an octave in length.

It is an object of the present invention to provide a fill note generation system wherein the notes forming the chord played on the accompaniment manual are loaded into a recirculating storage device without the necessity for scanning or multiplexing the keys of the accompaniment manual.

It is a further object of the present invention to provide a fill note generation system which is easily incorporated into the circuitry of existing organs wherein the solo manual only is multiplexed.

A still further object of the present invention is to provide a fill note generation system wherein certain notes which would normally be played as fill notes can be eliminated thereby preventing dissonance.

These and other objects of the present invention will become more apparent from a reading of the detailed description taken together with the accompanying drawings.

DESCRIPTION OF THE PREFERRED EMBODIMENT

Figure 1:
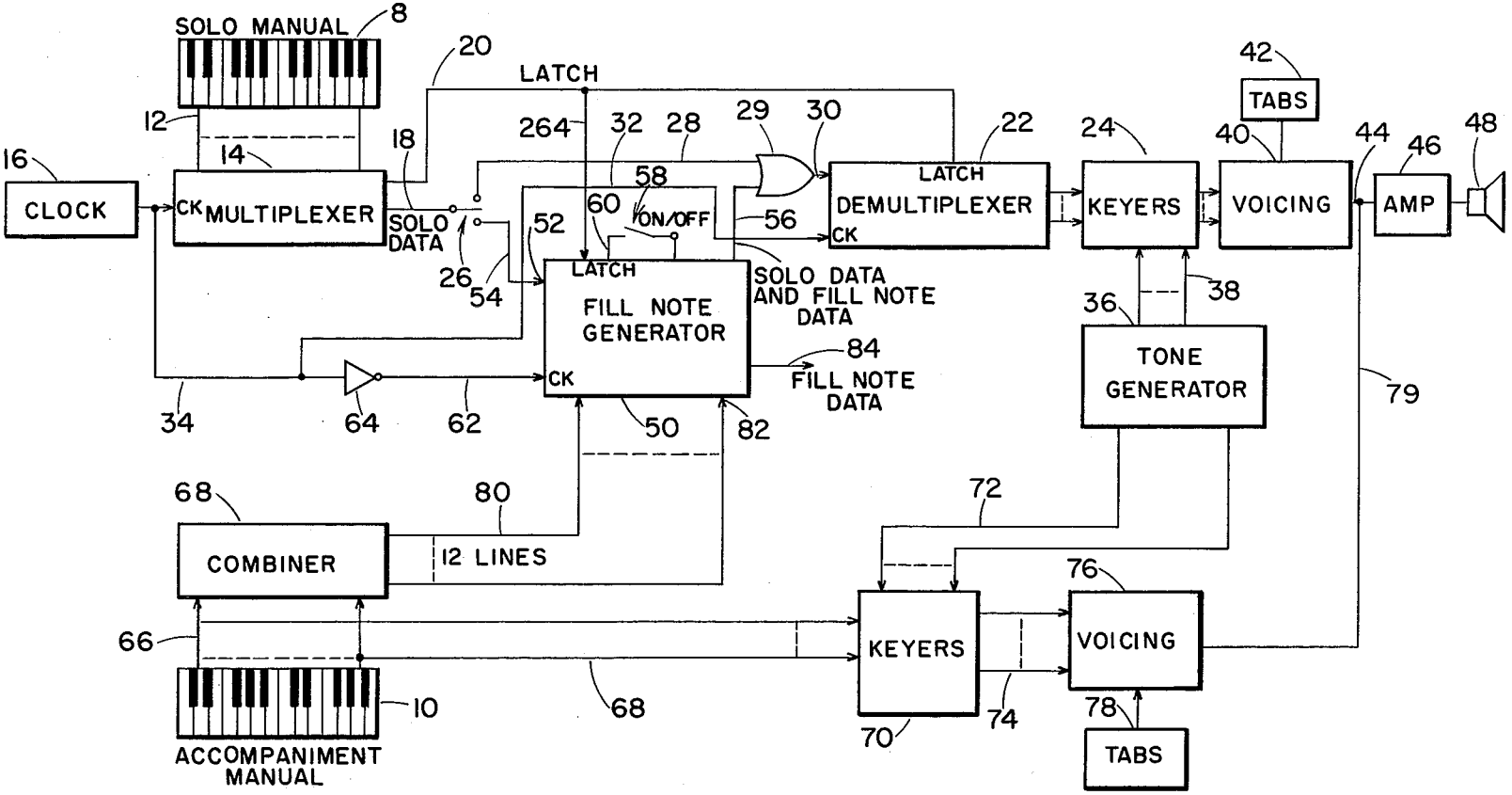
FIG. 1 is an overall block diagram of an electronic organ incorporating the fill note generator of the present invention.

Referring now to the drawings, and in particular to FIG. 1, there are illustrated schematically a solo manual 8 and an accompaniment manual 10. In the case of a spinet organ, the solo manual 8 would comprise the upper keys of the keyboard and the accompaniment manual 10 the lower keys of the keyboard. In the case of a two manual organ, solo manual 8 would be the upper forty-four note or sixty-one note manual, and accompaniment manual 10 the lower forty-four note or sixty-one note manual. The present invention is also useful with even larger organs having three or more keyboards wherein one would be designated the solo manual and the other the accompaniment manual.

Solo manual 8 is connected by lines 12 to multiplexer 14, which is clocked by clock generator 16. Multiplexer 14, which may be any well-known prior art multiplexer, repetitively scans the keys of solo manual 8 and develops on line 18 a time division multiplexed solo serial data stream comprising a plurality of time slots corresponding on a one-to-one basis with the keys of solo manual 8 and having keydown pulses in time slots corresponding to depressed ones of the keys. During an interval between the end of one scan and the beginning of the next scan of solo manual 8, multiplexer 14 produces a latch command pulse on latch command line 20, which is utilized to latch the serial data out of demultiplexer 22 and into keyers 24.

Demultiplexer 22 is of conventional design and may comprise, for example, a shift register (not shown) to which the data stream is supplied from line 18, switch 26, line 28 and OR gate 29 to the input 30, and is progressively shifted therethrough by clock pulses on line 32, which is connected to clock 16 by line 34. Respective latches (not shown) may be interposed between each stage of the shift register and a corresponding keyer 24, and the data in each stage of the shift register at the input of the respective latch is latched therein when the latch command pulse on line 20 is received. The data thus transferred from the shift register into the latches remains therein until the latches are again updated at the end of the next scan. An illustration of this type of demultiplexer is contained in U.S. Pat. No. 4,147,085. Such a demultiplexer is only exemplary, however, and any other suitable prior art demultiplexer would work as well. The latch command can be developed by decoding a particular count in the drivers (not shown) in multiplexer 14, by counting driving pulses for multiplexer 14, or by another suitable technique.

Keyers 24 are connected to tone generator 36 over lines 38 and function to key tones from tone generator 36 to voicing circuits 40 in accordance with the demultiplexed data transmitted to keyers 24 by demultiplexer 22. Voicing circuits 40 are controlled by tabs 42, and, by filtering and tone combination techniques, produce on output 44 tones which are simulative of various musical instruments, such as pipe organs, trumpets, violins, flutes, etc. The tones on line 44 are amplified by amplifier 46, the output of which is connected to speaker 48.

FIG. 1 illustrates fill note generator 50 as being interposed between multiplexer 14 and demultiplexer 22. The data input 52 for fill note generator 50 is connected over line 54 to single pole double throw switch 26. When switch 26 is in the lower position, solo data from multiplexer 14 will be transmitted to the input 52 of fill note generator 50. When switch 26 is in the upper position, the solo data is transmitted directly to demultiplexer 22 over line 28. The output line 56 of fill note generator 50 is connected through OR gate 29 to the input 30 of demultiplexer 22. Switch 26 is illustrated simply for the purpose of diagrammatically showing the overall system in block diagram form. In the preferred embodiment of the invention, however, the switching for the solo data on line 18 is accomplished within block 50. On/off switch 58 is connected to fill note generator 50 over line 60 and is operable for activating the fill note generation system within block 50. Fill note generator 50 is clocked by inverted clock pulses on line 62, which is connected to clock generator 16 through inverter 64.

Accompaniment manual 10 is connected by lines 66 to the inputs of combiner 68, there being one line 66 for each key of the accompaniment manual 10. Lines 66 are connected by lines 68 to accompaniment keyers 70, which are fed with tones from tone generator 36 over lines 72. Keyers 70 provide outputs over lines 74 to voicing circuits 76, which are controlled by tabs 78. The output of voicing circuits 76 is connected to the input of amplifier 46 over line 79 for amplification together with the tones from solo voicing 40.

Combiner 68 combines the inputs 66 from accompaniment manual 10 into twelve outputs 80 corresponding to the twelve pitches of the chromatic scale. Thus, all of the C's on accompaniment manual 10 are connected to one of lines 80, all of the C#'s are connected to a different single line 80, and so on. These twelve output lines 80 are connected to twelve inputs 82 of fill note generator to enable the generation of the appropriate fill note signals. Output 56 from fill note generator 50 comprises both solo data and fill note data and output 84 comprises fill note data only, in the case where this data is to be separately demultiplexed and voiced.

Figure 2A:
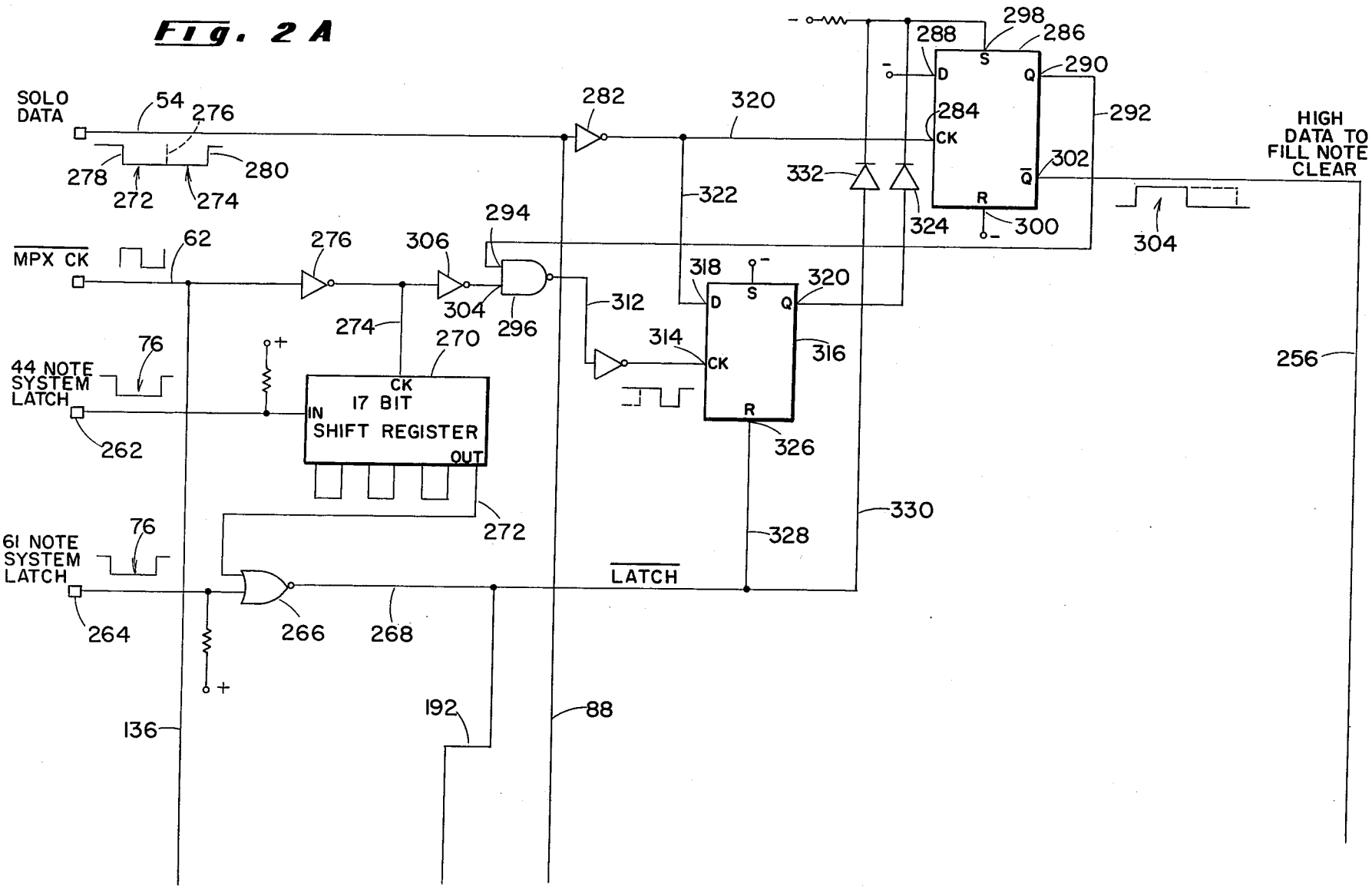
FIGS. 2A and 2B are a detailed schematic of the fill note generator block shown in FIG. 1.
Figure 2B:
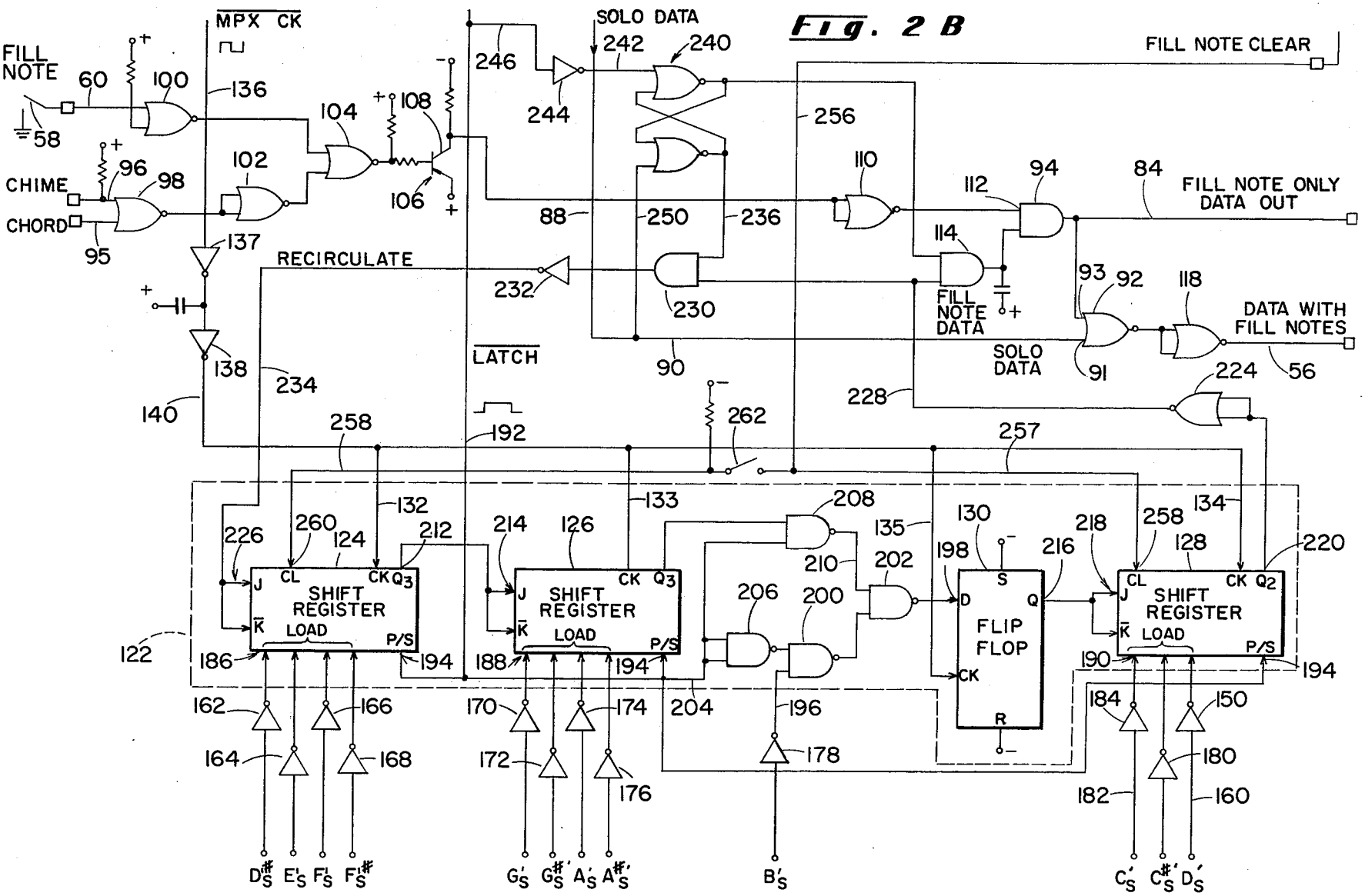

Referring now to FIGS. 2A and 2B, which illustrate in detail the fill note generator 50 including the high note data generator feature, the fill note generation system will be described in connection with sixty-one note solo and accompaniment manuals. Solo data on line 54, which is a time division multiplexed data stream wherein keydown signals appear as negative going pulses due to the fact that the circuitry is written in negative logic, is connected by lines 88 and 90 to one of the inputs 91 of NOR gate 92. The other input 93 of NOR gate 92 is the enabling input and is connected to the output of AND gate 94.

The fill note generation system of the present invention is intended for use in cases where the automatic chord feature, which is a feature that automatically generates chords by depressing a single note on the accompaniment manual, is deactivated. Furthermore, the chime voicing, which is customarily restricted to monophonic operation, must also be deactivated. When the logic levels on the inputs 95 and 96 of NOR gate 98 indicate that chimes voicing and the automatic chord feature have not been selected, and if switch 58 is closed thereby indicating that the operator has selected the fill note feature, then the output of NOR gate 100 and the output of NOR gate 98 as inverted by inverter 102 will cause NOR gate 104 to turn on transistor 106 so as to place a positive voltage (logic 0) on its collector 108, which is inverted by inverter 110 to place a logic 1 on the input 112 of AND gate 94. This enables AND gate 94 so that the output of AND gate 114, which is the fill note data, is gated to output line 84 and to the input of NOR gate 92, where it is combined with solo data on line 90. The output of NOR gate 92 is inverted by inverter 118 and placed on output line 56.

Figure 3A:
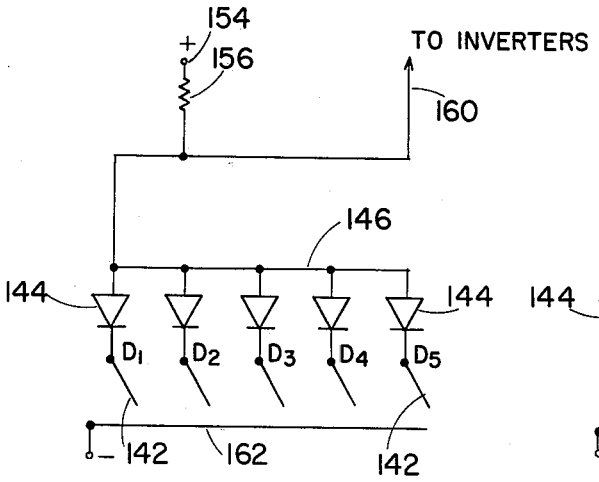
FIGS. 3A and 3B are schematics of the combining circuitry for the keyswitches of the accompaniment manual.
Figure 3B:
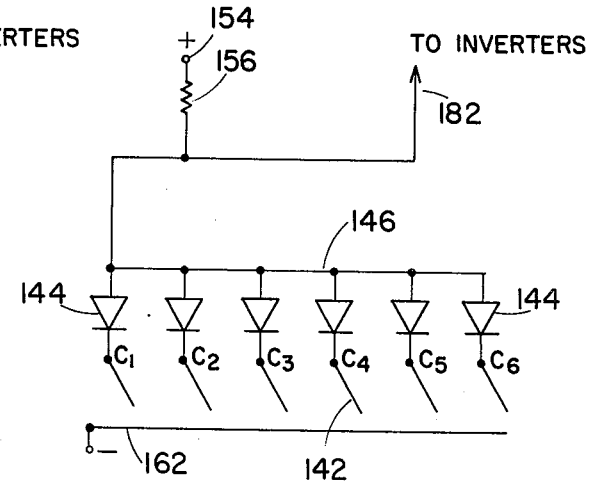

A multistage shift register indicated generally by reference numberal 122 comprises three 4035 JK shift registers 124, 126 and 128 and a 4013 D-type flip-flop 130 connected in series. Shift registers 124, 126 and 128 and flip-flop 130 are clocked by clock pulses on lines 132, 133, 134 and 135, respectively, which are commonly connected to the inverted clock pulse line 62 over line 136, inverters 137 and 138, and line 140. With reference to FIGS. 3A and 3B, it will be seen that the keyswitches 142, which are actuated by the keys of accompaniment manual 10, are grouped according to individual pitches of the chromatic scale. FIG. 3A illustrates the interconnection for all of the D natural keyswitches 142 of the accompaniment manual. The keyswitches 142 are connected through diode 144 to bus 146, and from there to inverter 150 (FIG. 2B). Line 152 is connected to a logic 0 on terminal 154 through pull up resistor 156. This arrangement results in a logic 1 (negative voltage) appearing on line 160 and at the input of inverter 150 when any or all of the D natural keyswitches 142 are closed so as to come into contact with rail 162, which is at a logic 1 voltage level. When all of the D natural keyswitches 142 are open, then line 160 and the input to inverter 150 will be at a logic 0, which is a positive voltage. The arrangement illustrated in FIG. 3A is identical for each of the remaining keyswitch groups with the exception of the C naturals. As illustrated in FIG. 2B, the common output for the combined D# keyswitches is connected to inverter 162, the output for the E natural keyswitches is connected to inverter 164, the output for the F natural keyswitches is connected to inverter 166, the output for the F# keyswitches is connected to inverter 168, the output for the G natural keyswitches is connected to inverter 170, the output for the G# keyswitches is connected to inverter 172, the output for the A natural keyswitches is connected to inverter 174, the output for the A# keyswitches is connected to inverter 176, the output for the B natural keyswitches is connected to inverter 178, and the output for the C# keyswitches is connected to inverter 180. FIG. 3B illustrates the situation for the C natural keyswitches, which are six in number rather than five. For the sake of clarity, the elements of FIG. 3B have been numbered identically to those of FIG. 3A. The output line 182 for the C natural keyswitches 142 is connected to inverter 184.

Shift register 124, which is connected as a four bit shift register, has its load inputs 186 connected to the outputs of inverters 162, 164, 166 and 168. Similarly, the load inputs 188 of four bit shift register 126 are connected to the outputs of inverters 170, 172, 174 and 176. Shift register 128 is connected as a three bit shift register and has its load inputs 190 connected to inverters 184, 180 and 150.

Shift registers 124, 126 and 128 are loaded once each scan of the solo manual 8 during latch command, and this is accomplished by connecting the inverted latch command pulse on line 192 to the parallel/serial inputs 194 of shift registers 124, 126 and 128. If a keyswitch 142 is closed, this will result in a logic 0 (positive voltage) being loaded in, and if the keyswitch 142 is open, then a logic 1 will be loaded. The data on line 196 from the B natural keyswitches 142 is loaded into the D input 198 of flip-flop 130 through NAND gate 200 and NAND gate 202. During latch command, the logic 0 pulse on line 204 is inverted by inverting NAND gate 206, and this enables NAND gate 200 so that the data on line 196 can pass to NAND gate 202. During latch, the logic 0 on line 204 will disable NAND gate 208 so that its output on line 210 will be at a logic 1 thereby enabling NAND gate 202. This results in a logic 0 on the input 198 of flip-flop 130 and loads the data pulse therein.

The $Q_3$ output 212 of shift register 124 is connected to the JK inputs 214 of shift register 126, and the $Q_3$ output of shift register 126 is connected to the D input of flip-flop 130 through NAND gates 208 and 202. NAND gate 208 is enabled at all times other than during latch so that data from the $Q_3$ output of shift register 126 is permitted to pass. The Q output 216 of flip-flop 130 is connected to the JK inputs 218 of shift register 128. As shift registers 124, 126 and 128 and flip-flop 130 are clocked, the data loaded therein is shifted along in synchronism with the solo manual multiplexer 14. The scan cycle for multiplexer 14 is sixty-four counts in length with sixty-one counts for the sixty-one keys of the solo manual 8 and three additional counts before scanning is again resumed. Latch command occurs on the sixty-second count, and it is at this time that the data is loaded into shift register 122. In order to permit the data being shifted out of the $Q_2$ output 220 of shift register 122 to be synchronized with the scanning of the keys of solo manual 8, the data for all of the C naturals is loaded into the input of shift register 128 which is two stages removed from the final stage. Thus, during the sixty-third and sixty-fourth counts, this data is stepped along so that the C natural data will appear at the output 220 of shift register 122 at exactly the same time that the highest key of solo manual 8, which is a C natural, is scanned. The solo manual 8 is scanned from top to bottom so that the progression is C natural, B natural, A#, etc.

The output data on output 220 is inverted by NOR gate inverter 224 and recirculated back to the $\overline{JK}$ inputs 226 of the first shift register 124 via a recirculation line including lines 228, AND gate 230, inverter 232 and line 234. Recirculation is permitted by enabling AND gate 230 with a logic 1 on line 236 from RS flip-flop 240. RS flip-flop 240 is set by the latch command pulse on line 242, which connects to line 192 through inverter 244 and line 246. Thus, at the end of each scan, flip-flop 240 is set, thereby enabling AND gate 230 so that all of the data appearing at the output 220 of shift register 122 will be recirculated back to the $\overline{JK}$ inputs 226 of four bit shift register 124.

When the first pulse of solo data appears on line 88, however, this is connected to RS flip-flop 240 over line 250 and resets it thereby disabling AND gate 230. Since no data is being recirculated, shift registers 124, 126, and 128 and flip-flop 216 will empty themselves during the next twelve clock cycles, and after that time no data will appear at the output of shift register 128 until new data is again loaded during latch command. This is the mechanism by which the twelve bit window is provided, which ensures that only data which is within an octave below the first occurring data pulse in the solo data stream will form the fill notes. Until the first data pulse appears, however, data will continue to recirculate through shift register 122 once for each octave of the solo manual 8 which is scanned so that if the highest note played on the solo manual 8 does not occur for several octaves of scan, the data loaded therein from the accompaniment manual 10 will be retained and made available for the generation of the fill notes.

The fill note data on line 228 is passed by AND gate 114, which is enabled whenever RS flip-flop 240 is reset so that the fill note data occurs only after the occurrence of the first data pulse in the solo data stream. At all other times, AND gate 114 is disabled and no fill note data will appear at its output.

As discussed earlier, when AND gate 94 is enabled by the closing of switch 58 and the absence of chord or chime select data on lines 95 and 96, the fill note data will be combined with the solo data by NOR gate 92, and then inverted by inverter 118. Fill note data only will appear on line 84 when AND gate 94 is enabled.

When the data on line 56 is demultiplexed by demultiplexer 22, keyers 24 and the remaining output circuitry will produce tones corresponding to the notes played on the solo manual 8, including the highest played note, the notes played on the accompaniment manual 10, and also fill notes which correspond to certain ones of the notes played on the accompaniment manual that sound in the octave immediately below the highest note played on the solo manual. If one of the notes played on the accompaniment manual is released, and this note is also one which is utilized as a fill note, the fill note will also disappear. Conversely, if the chord played on the accompaniment manual 10 is augmented by playing one or more additional keys, these notes will also appear as fill notes, assuming that they are not otherwise eliminated from the fill note data stream on the output 220 of shift register 128.

In order to prevent dissonance which might occur if fill notes are played that are too close to the highest note played on the solo manual, it is generally desirable to eliminate any such fill notes. This is accomplished by clearing all of the stages of the last shift register 128 by transmitting a logic 0 pulse on line 256 to the clear input 258 of shift register 128. As will be described in detail below, this pulse is generated at the same time as the first occurring pulse in the solo data stream and results in no fill note data being produced at the output 220 of shift register 128 for the time slot of the highest occurring note in the solo data stream and for the next two time slots. This will not prevent the sounding of the highest note played on the solo manual, however, because this is still present on the solo data input line 88. The next two notes, however, will not be played even though they are loaded into shift register 122 from the accompaniment manual 10. If it is desirable to eliminate even more of the fill notes, shift register 124 can be cleared by the same pulse on line 258 connected to the clear input 260. This is accomplished by closing switch 262.

The circuitry for generating the clearing pulse is illustrated in FIG. 2A, and is the subject of a copending patent application Ser. No. 139,882 filed Apr. 14, 1980 in the name of Stephen L. Howell and owned by the assignee of the present application. In order to adapt the system for use in both forty-four note manual organs and sixty-one note manual organs, two separate latch command inputs 262 and 264 are provided. For sixty-one note manuals, which is the embodiment illustrated in FIG. 2B, the latch command pulse 76, which is a negative going pulse, is brought in on line 264 and passes through NOR gate 266, at which point it is inverted and becomes the $\overline{\text{latch}}$ signal on line 268. In order to permit the system to function properly with a forty-four note manual as well, the latch pulse 76 on line 262 passes through a seventeen bit shift register 270 and appears on the output line 272 seventeen bits later, which is exactly the same time at which the latch command for a sixty-one note manual would occur. Shift register 270 is clocked by the multiplex clock train on line 274, which is the original inverted clock train on line 62 inverted by inverter 276.

The solo data stream on line 54 has been illustrated by two adjacent pulses 272 and 274, which would occur if two adjacent keys of solo manual 8 were depressed. It will be noted that each of the pulses 272 and 274 occupies the entire time slot so that the trailing edge of the first occurring pulse 272 is coincident in time with the leading edge of the next pulse 274, as indicated by a dotted line 276. In this situation, pulses 272 and 274 appear as a single pulse having a leading edge 278 and a trailing edge 280, the entire width of which spans two adjacent time slots. It will be noted that pulses 272 and 274 are negative going and make a transition from logic level 0 to logic level 1 when their corresponding keys on keyboard 8 are depressed.

Pulses 272 and 274 are inverted by inverter 282 and connected to the clocking input 284 of 4013 D-type flip-flop 286, which functions in the present circuitry as a latch. Because flip-flop or latch 286 is a positive edge triggered latch, when the leading edge 278 of pulse 272 appears at clocking input 284, latch 286 will transfer the logic 1 level on its data input 288 to the Q output 290 connected by line 292 to one of the inputs 294 of NAND gate 296. At this point, the Set input 298 and Reset input 300 are connected to negative voltage logic 1 levels so that the logic 1 level will remain on $\overline{Q}$ output 290. The Q output 302 is the output on which the high note data pulse 304 appears, which is a positive going pulse making the transition from logic 1 to logic 0 as illustrated.

The $\overline{\text{clock}}$ pulse train on line 62 is connected to the second input 304 of NAND gate 296 through inverters 306 and 276. With reference to the timing diagrams illustrated in FIGS. 4 and 5, it will be noted that the leading edge 278 of the first occurring pulse 272 is delayed slightly from the leading edge 308 of clock train 310, the inversion of which is illustrated in FIG. 2A. This is because the data pulse 272 is triggered by the leading edge 308 of clock train 310 in multiplexer 14 and will, of necessity, be delayed somewhat in time.

Figure 4:
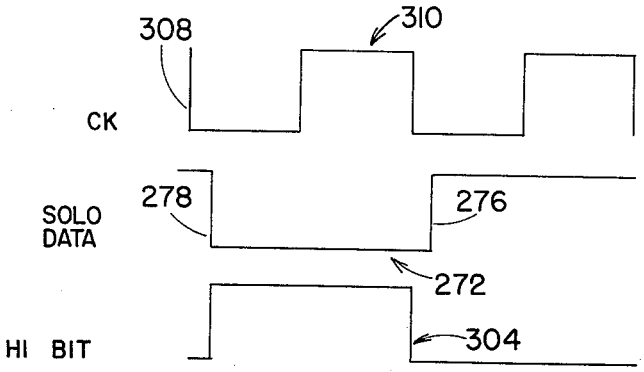
FIGS. 4 and 5 are timing diagrams for the generation of the high note data bit used in clearing the shift register of FIG. 2B.
Figure 5:
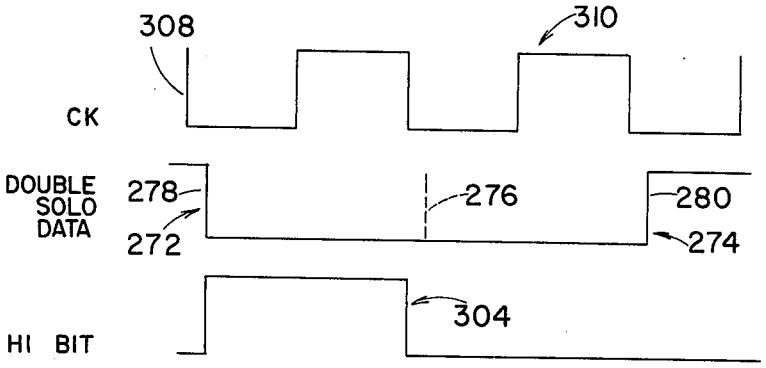

At the time of the leading edge 308 of clock train 126, NAND gate 296 will be disabled because there is a logic 0 at input 304. Before this time, data pulse 272 has not yet occurred so there will also be a logic 0 at the input 294 of NAND gate 296. After the positive going pulse on line 292 is received at input 294 of NAND gate 296 and the $\overline{\text{clock}}$ signal on input 304 makes the negative going transition to a logic 1 level, NAND gate 296 will be enabled so that a logic 0 will appear on its output line 312 thereby producing a logic 1 on the clocking input 314 of 4013 D-Type flip-flop 316. Flip-flop 316, which functions as a latch in the present circuit, is positive edge triggered so that with its clocking input 314 at a logic level 1 (negative voltage), nothing occurs until the end of the next half cycle of clock train 310 at which time NAND gate 296 is again disabled thereby placing a logic 0 in the clocking input 314 of latch 316, which results in a positive going transition as illustrated in FIG. 2A. This clocks latch 316 so as to transfer the logic level on its D input 318 to the Q output 320. It will be noted that the D input 318 is connected to the inverted data on line 320 by a line 322, and, due to the fact that pulse 278 is delayed slightly from the clock train 310, as illustrated in FIGS. 4 and 5, a logic 0 will still be present on input 318. This logic 0, which is a positive voltage, will be transferred to the Q output 320, and will pass through diode 324 to the set input 298 of latch 286. This causes latch 286 to change states so that the Q output 290 makes a transition to logic level 0, and the Q output 302 makes the transition to a logic level 1, thereby terminating the high note data pulse 304.

At the same time, NAND gate 296 is disabled due to the setting of latch 286, which will remain set for the rest of the scan due to the fact that no further clocking data can appear at the clocking input 314 of latch 316. At the end of the scan, the $\overline{\text{latch}}$ signal from NOR gate 266, which is connected to the reset input 326 of latch 316 over line 328, will reset latch 316. This takes the set signal off latch 286, which enables latch 286 to again be clocked, thereby enabling AND gate 296. Line 330 connects between the $\overline{\text{latch}}$ signal on line 268 and the set input 298 of latch 286 through diode 332 so as to place latch 286 in the set condition on power-up. This prevents spurious signals from triggering latch 286 and causing false data on output 302.

As discussed above, the positive going high note clear pulse 304 on line 256 is connected to the clear input 258 of shift register 128, and selectively to the clear input 260 of shift register 124. If desired, this same pulse 304 could be inverted and utilized as the data pulse which opens the "window". In this case, the window circuitry would then include the high note generation circuitry illustrated in FIG. 2A. Because solo data is readily available, however, the preferred embodiment utilizes the solo data stream directly to initiate the generation of the fill note data pulses.

Although, in a preferred embodiment of the invention, all of the keys of the accompaniment manual are capable of producing fill note data, in some cases it may be desirable to permit only a group of the accompaniment keys to be interconnected for loading into shift register 122.

While this invention has been described as having a preferred design, it will be understood that it is capable of further modification. This application is, therefore, intended to cover any variations, uses, or adaptations of the invention following the general principles thereof and including such departures from the present disclosure as come within known or customary practice in the art to which this invention pertains and fall within the limits of the appended claims.

What is claimed is:

1. An electronic musical instrument comprising:

a keyboard having a plurality of playing keys actuating respective keyswitches and comprising a solo portion customarily played by the right hand and an accompaniment portion customarily played by the left hand, said playing keys corresponding to notes of the musical scale, multiplexer means for scanning the keyswitches of the solo portion of said keyboard and generating on an output a time division multiplexed solo data stream on each scan of the keyboard comprising keydown signals in respective discrete time slots for each actuated keyswitch of the solo portion of the keyboard, at least a group of the keyswitches of the accompaniment portion of the keyboard being interconnected in a plurality of sets such that each set comprises all of the keyswitches in said group corresponding to a particular diverse pitch of an octave length chromatic scale, and the keyswitches in each set being connected to a common output, a multistage shift register means synchronized with said multiplexer means and having a plurality of load inputs at respective ones of its stages connected to the respective outputs of said accompaniment portion keyswitches, and producing on an output a fill note time division multiplexed data stream comprising keydown signals in time slots corresponding to keydown signals loaded into its inputs from the outputs of the sets of accompaniment portion keyswitches, window means having an input connected to the output of said shift register means and an input connected to the output on which the solo data stream appears and an output, said window means gating to its output the data stream on the output of said shift register means for a predetermined number of time slots following receipt by said window means of a predetermined keydown signal in the solo data stream, and output means connected to the output of said window means and controlled by the fill note data stream on the output of said window means for producing tones in accordance with the keydown signals in the fill note data stream on the output of said window means.

2. The musical instrument of claim 1 wherein all the keys of the accompaniment manual are interconnected to form twelve said sets wherein said sets correspond respectively to the twelve pitches of an octave length chromatic scale, and said shift register means includes twelve stages connected respectively to the outputs of the keyswitches in said sets.

3. The musical instrument of claim 2 wherein said shift register means is connected as a recirculating shift register such that its output is connected to a serial input thereof.

4. The musical instrument of claim 1 wherein said shift register means recirculates said fill note data over a recirculation line from the output of said shift register means to a serial input thereof, and said window means includes a gate means connected in said recirculation line and responsive to the occurrence of said predetermined keydown signal for blocking the fill note data from reaching said shift register serial input when said predetermined keydown signal appears in the solo data stream.

5. The musical instrument of claim 4 wherein said multiplexer means generates a latch command at the end of each scan of the keyboard and said window means is responsive to said latch command for again enabling said recirculation line to permit fill note data to reach the serial input of said shift register means.

6. The musical instrument of claim 4 wherein said predetermined keydown signal is the first occurring keydown signal in the solo data stream for each scan of the keyboard by said multiplexer means.

7. The musical instrument of claim 1 wherein said predetermined keydown signal is the first occurring keydown signal in the solo data stream for each scan of the keyboard by said multiplexer means.

8. The musical instrument of claim 1 wherein said output means includes: a demultiplexer having an input connected to said window means such that it receives the fill note data stream on the output of said window means, means associated with said shift register means and said window means for preventing the occurrence of fill note keydown signals on the input of said demultiplexer which occur within a predetermined number of time slots of said predetermined keydown signal in the solo data stream.

9. The musical instrument of claim 8 wherein said preventing means comprises means responsive to said predetermined keydown signal and connected to said shift register means for clearing data from at least one stage thereof on the occurrence of said predetermined keydown signal.

10. The musical instrument of claim 8 including means for combining said solo data stream and said fill note data stream, and wherein the combined data stream is connected to the input of said demultiplexer.

11. The musical instrument of claim 1 including means responsive to the occurrence of said predetermined keydown signal and connected to said shift register means for clearing a plurality of the stages of said shift register means on the occurrence of said predetermined keydown signal.

12. The musical instrument of claim 11 wherein said predetermined keydown signal is the first occurring keydown signal in the solo data stream for each scan of the keyboard by said multiplexer means.

13. An electronic musical instrument comprising:

a keyboard having a plurality of playing keys actuating respective keyswitches and comprising a solo portion customarily played by the right hand and an accompaniment portion customarily played by the left hand, said playing keys corresponding to notes of the musical scale, multiplexer means for scanning the keyswitches of the solo portion of said keyboard and generating on an output a time division multiplexed solo data stream on each scan of the keyboard comprising keydown signals in respective discrete time slots for each actuated keyswitch of the solo portion of the keyboard, at least a group of the keyswitches of the accompaniment portion of the keyboard being interconnected in a plurality of sets such that each set comprises all of the keyswitches in said group corresponding to a particular diverse pitch of an octave length chromatic scale, and the keyswitches in each set being connected to a common output, recirculating storage means synchronized with said multiplexer means and comprising: a serial output, a serial input, a plurality of load inputs connected to the respective outputs of said sets of accompaniment portion keyswitches, means for causing data at its load inputs to be loaded into said storage means once each scan of the keyboard, means for shifting the data loaded therein to produce at its output a fill note time division multiplexed data stream synchronized with said solo data stream comprising keydown signals in time slots corresponding to keydown data loaded into said load inputs, and recirculate means for connecting said fill note data stream to the serial input of said storage means to recirculate said fill note data stream a plurality of times each scan of the keyboard, said recirculate means including means having an input connected to said serial data stream for interrupting the recirculating of the fill note data stream when the first occurring keydown signal in said solo data stream is received by the input of said means for interrupting, gate means connected to the output of said recirculate storage means and including an output and an input connected to the solo data stream, said gate means gating said fill note data stream to the output of said gate means when the first occurring keydown signal in the solo data stream is received at its input, and output means connected to the output of said gate means and controlled by the fill note data stream on the output of said gate means for producing tones in accordance with the keydown signals in the fill note data stream on the output of said gate means.

14. The musical instrument of claim 13 wherein: said storage means is a shift register and said means for interrupting comprises a gate means interposed between said shift register output and the serial input of said storage means and includes a control input connected to said serial data stream, said gate means is disabled by the first occurring keydown signal in the solo data stream, said multiplexer means generates a latch command at the end of each scan of the keyboard and said gate means is enabled by said latch command.

15. The electronic musical instrument of claim 13 wherein said output means includes: a demultiplexer having an input connected to the output of said gate means, and means associated with said recirculating storage means for preventing the occurrence of fill note keydown signals on the input of said demultiplexer which occur within a predetermined number of time slots of said first occurring keydown signal in the solo data stream.

16. The musical instrument of claim 15 including means for combining the solo data stream and the fill note data stream and wherein the combined data stream is connected to the input of said demultiplexer.

17. The musical instrument of claim 15 wherein said means for preventing comprises means connected to said recirclating storage means for clearing data from a portion of said storage means on the occurrence of said first occurring keydown signal.

18. An electronic musical instrument comprising:

a keyboard having a plurality of playing keys actuating respective keyswitches and comprising a solo portion customarily played by the right hand and an accompaniment portion customarily played by the left hand, said playing keys corresponding to notes of the musical scale, multiplexer means for scanning the keyswitches of the solo portion of said keyboard and generating on an output a time division multiplexed solo data stream on each scan of the keyboard comprising keydown signals in respective discrete time slots for each actuated keyswitch of the solo portion of the keyboard, at least a group of the keyswitches of the accompaniment portion of the keyboard being interconnected in a plurality of sets such that each set comprises all of the keyswitches in said group corresponding to a particular diverse pitch of an octave length chromatic scale, and the keyswitches in each set being connected to a common output, a multistage shift register means synchronized with said multiplexer means and having a plurality of load inputs at respective ones of its stages connected to the respective outputs of said accompaniment portion keyswitches, and producing on an output a fill note time division multiplexed data stream comprising keydown signals in time slots corresponding to keydown signals loaded into its inputs from the outputs of the sets of accompaniment portion keyswitches, window means having an input connected to the output of said shift register means and an input connected to the output on which the solo data stream appears and an output, said window means gating to its output the data stream on the output of said shift register means for a predetermined number of time slots following receipt by said window means of a predetermined keydown signal in the solo data stream, a preferential note data generator means having an input connected to said solo data stream for detecting the first occurring keydown signal in said solo data stream and generating a cyclically recurring monophonic serial data stream on an output comprising a plurality of time slots synchronized with and temporally coextensive with the solo data stream and a single pulse, said single pulse being in the time slot corresponding to the time slot of said first occurring keydown signal, said shift register means having a clear input connected to said preferential note means output such that a plurality of stages of said shift register means are cleared by said single pulse, and demultiplexing and tone producing means connected to the output of said shift register means for demultiplexing said fill note data stream and producing tones in accordance with the keydown signals in said fill note data stream.

19. The musical instrument of claim 18 wherein said shift register means is a recirculating shift register having recirculate means connected between its output and a serial input thereof for recirculating said fill note data stream, and said window means includes means for disabling said recirculate means on the occurrence of said first occurring keydown signal in the solo data stream.

20. In an electronic keyboard musical instrument having a keyboard having a plurality of playing keys actuating respective keyswitches and comprising a solo portion customarily played by the right hand and an accompaniment portion customarily played by the left hand, wherein the keys correspond to a plurality of octaves of notes of the musical scale wherein each octave comprises twelve notes corresponding to the twelve notes of the chromatic scale, a method for producing fill notes comprising:

scanning the keyswitches of the solo portion of the keyboard and producing a time division multiplexed solo data stream on each scan of the keyboard comprising keydown signals in respective discrete time slots for each actuated keyswitch of the solo portion of the keyboard, producing a parallel format data word comprising twelve bit locations corresponding, respectively, to the twelve notes of the chromatic scale and wherein keydown signals are present in bit locations corresponding to depressed keys of the accompaniment manual of the same notes, recirculating the data word through a recirculating storage device a plurality of times during each scan of the keyboard such that at an output of the storage device a fill note time division multiplexed data stream is produced which is synchronized with the solo data stream, and demultiplexing only that portion of the fill note data stream that occurs after the first actuated keyswitch of the solo portion of the keyboard is scanned and only for a predetermined number of time slots less than or equal to an octave in length.

* * * * *